United States Patent [19]

Dring

[11] 4,196,935

[45] Apr. 8, 1980

[54] EQUIPMENT FOR LAYING ELONGATE MATERIAL

[75] Inventor: Eric Dring, Pleasley, England

[73] Assignee: Coal Industry (Patents) Limited, London, England

[21] Appl. No.: 953,248

[22] Filed: Oct. 20, 1978

[30] Foreign Application Priority Data

Nov. 15, 1977 [GB] United Kingdom ..... 47432/77

[51] Int. Cl.[2] ..... E21C 35/20; E21D 11/14

[52] U.S. Cl. ..... 299/33; 299/11; 299/45

[58] Field of Search ..... 299/11, 33, 45; 405/291

[56] References Cited

U.S. PATENT DOCUMENTS 4,099,785 7/1978 Groetschel ..... 299/11

FOREIGN PATENT DOCUMENTS 2634557 9/1977 Fed. Rep. of Germany ..... 299/11

*Primary Examiner*—Ernest R. Purser

*Attorney, Agent, or Firm*—James C. Wray

[57] ABSTRACT

Equipment for laying a layer of wire mesh adjacent to a newly exposed mine roof comprises storage means (10) for a roll of mesh (11) and resilient guide means (12) for guiding the mesh (72) as it unwinds towards the newly exposed mine roof (5).

10 Claims, 3 Drawing Figures

EQUIPMENT FOR LAYING ELONGATE MATERIAL

This invention relates to equipment for laying a layer of elongate material, for example, wire mesh or wire mesh with a sheet backing, adjacent to an exposed rock or mineral surface in an underground mine.

In particular, the present invention relates to such equipment securable to a mining machine including a cutter for cutting rock or mineral from a working face and a loading member positionable adjacent to the rear of the cutter for urging cut rock or mineral towards a conveyor arranged along the working face, the equipment laying the layer of elongate material adjacent to the rock or mineral surface newly exposed by the cutter as it traverses along the working face.

Previously, it has been proposed to mount equipment for laying a layer of wire mesh adjacent to an exposed mine roof on the body of the mining machine, the equipment being cantilivered from the body of the machine into the newly formed track left directly behind the cutter. Unfortunately, such known equipment suffered from the disadvantage that it was only suitable for mining machines where the cutter preceded the machine body during the traverse of the machine along the working face. As it is frequent practice to have a cutter trailing behind the machine body such known equipment has tended to be little exploited.

An object of the present invention is to provide equipment for laying a layer of elongate material which tends to overcome or reduce the above mentioned disadvantage and which can be used with a mining machine having a cutter which trails behind the machine body during the machine's traverse along the working face.

According to the present invention, equipment for laying a layer of elongate material adjacent to a newly exposed rock or mineral surface formed by a mining machine cutter as the machine traverses along a working face, a loading member for cut rock or mineral including a component positioned adjacent to the rear of the cutter, comprises storage means for a coil of elongate material which, in use, as the machine traverses along the working face is uncoiled, and resilient guide means for guiding a newly unwound portion of the elongate material towards said newly exposed rock or mineral surface, the storage means and the resilient guide means being securable to the loading member component.

Preferably, the storage means when empty is collapsable.

Advantageously, the guide means comprises a plurality of resilient fingers adapted to be pivotally mounted relatively to the loading member component.

The present invention also provides a loading member in combination with equipment as defined above.

Further, the present invention provides a mining machine comprising a cutter and loading member in combination with equipment as defined above.

By way of example only, one embodiment of the present invention will be described with reference to the accompanying drawings, in which.

Figure 1:
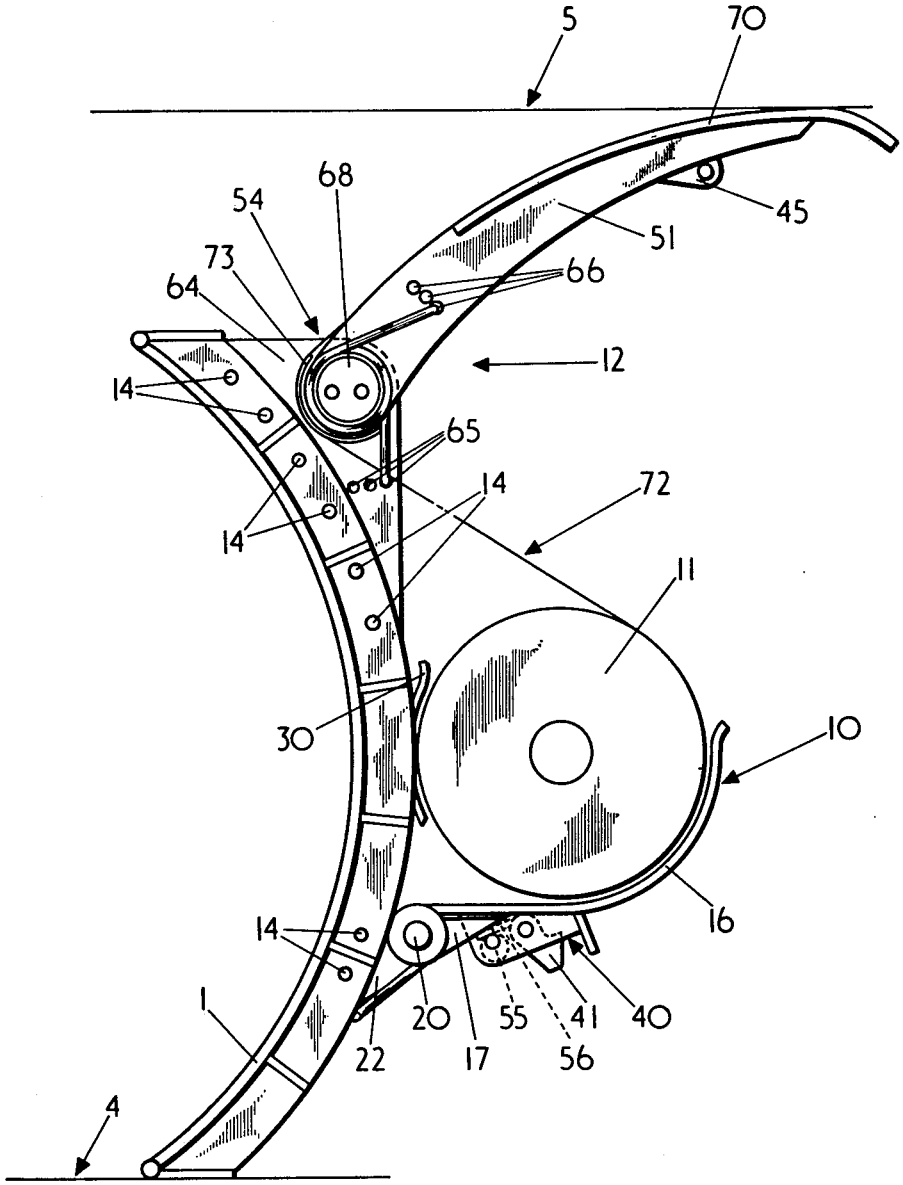
FIG. 1 is a side view of a mining machine loading member provided with equipment constructed in accordance with the present invention the equipment being shown in one operational position.

The drawings show a loading member in the form of a curved cowl component 1 which is attached by arms (not shown) to a swivel support on a well known shearer mining machine having a rotary cutter arranged to cut rock or mineral from a working face as the machine traverses along a working face, the cowl component 1 being mounted adjacent to the rear of the rotary cutter and co-operating with loading vanes provided on the rotary cutter to urge the cut rock or mineral towards a conveyor extending along the working face. A portion of the conveyor having a guide ramp is shown at 2 in FIG. 2. The mining machine is not shown in the drawings.

As the machine traverses along the working face the cowl component 1 is slid along the newly formed mine floor 4 left directly behind the cutter. The upper portion of the cowl is adjacent to the newly formed mine roof 5 left directly behind the cutter.

The cowl component 1 is provided with equipment for laying a layer of elongate material, for example, wire mesh or wire mesh with a sheet backing, adjacent to the newly exposed rock or mineral mine roof 5.

The equipment comprises collapsable storage means 10 for a coil or reel 11 of the elongate material, (the coil or reel 11 is omitted from FIG. 2) the resilient guide means 12 for guiding the material as it is unwound towards the newly exposed mine roof. Both the storage means 10 and the guide means 12 are secured to the rear of the cowl 1 by bolts 14.

The storage means 10 comprises a pivotally mounted trough 16 formed by a curved plate having two lugs 17 and 18 (not shown in FIG. 1) pivotally mounted on a cross pin 20 which in turn is carried on two brackets 22 and 24 secured to the rear of the cowl 1 by two of the previously mentioned bolts 14. In FIG. 1 the trough is shown in a fully loaded position at 16 and in FIG. 3 in a fully collapsed or empty position at 16'. When loaded the coil or reel 11 of elongate material is slidably accommodated within the trough 16 and a breast plate 30 (not shown in FIG. 2) fixedly secured to the rear surface of the cowl. The coil or reel is permitted to rotate within the storage means to unwind the elongate material as required as describer later.

A coil spring 31 is mounted on the cross pin 20 intermediate a retaining bush 32 and a vertical flange 34 of the cowl component 1 one end of the spring being fixedly engaged in an anchor position abutting the vertical flange while the other end abuts the lower surface of the trough 16 tending to urge the trough about its pivotal mounting towards the collapsed position. One action of the spring 31 is to act as a brake on the unwinding coil or reel 11 ensuring that the elongate material is only unwound when a sufficient pull force is applied to the material.

Figure 2:
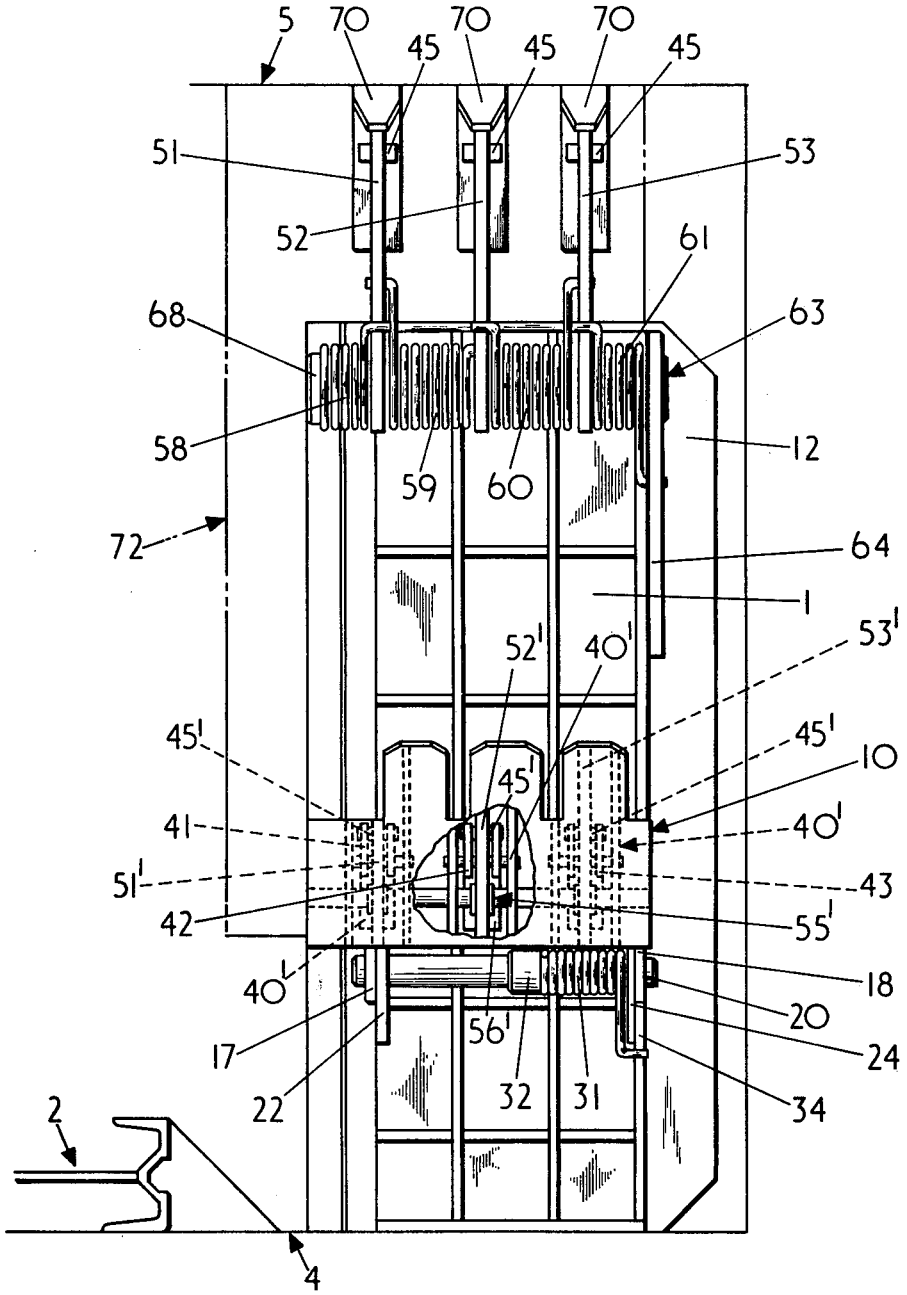
FIG. 2 is an incomplete rear view of FIG. 1.
Figure 3:
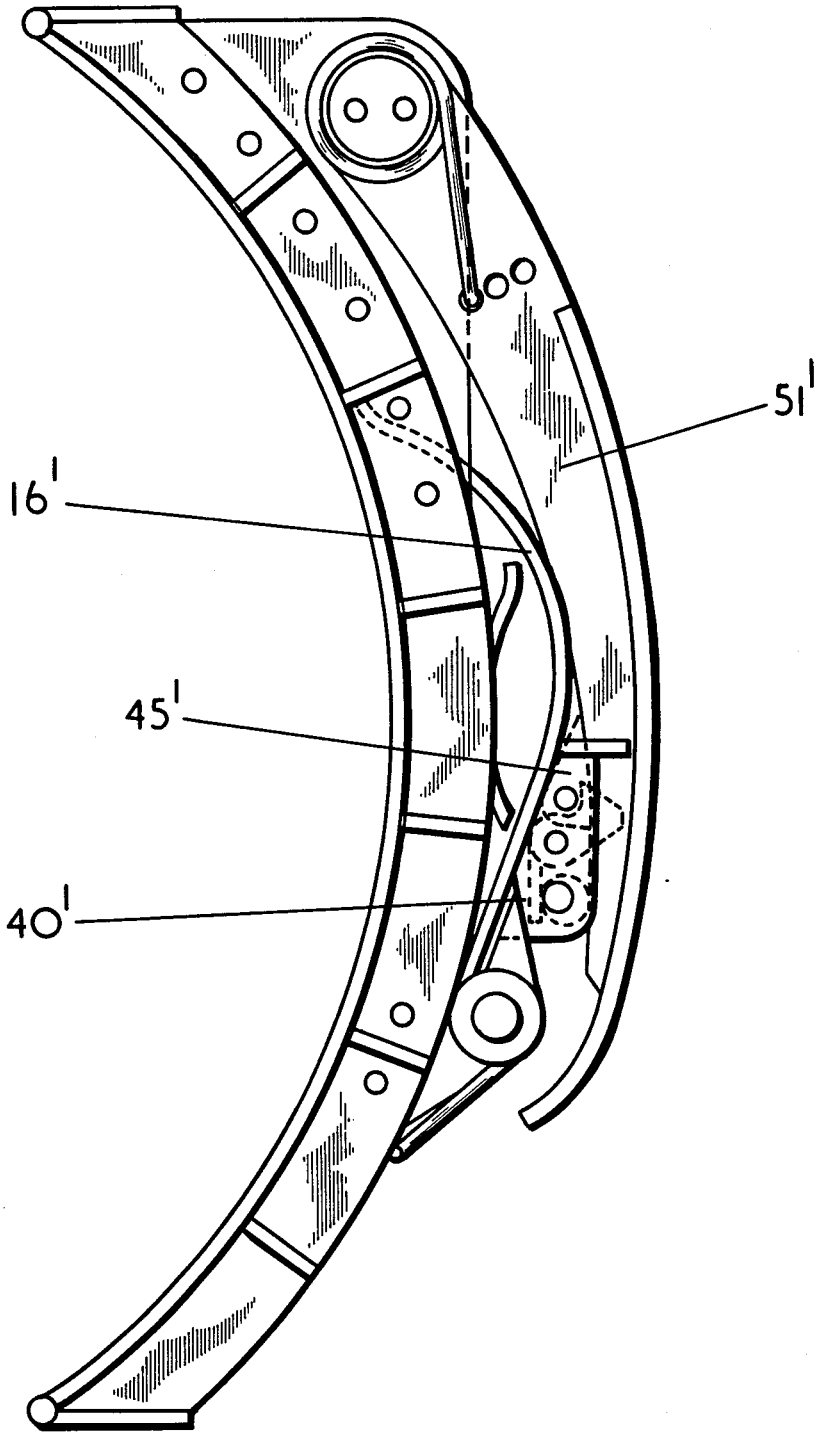
FIG. 3 is a side view similar to FIG. 1, but with the equipment in an alternative operational position.

The lower surface of the trough 16 is provided with pivotally mounted catch means 40 comprising three pairs of similar resiliently biassed detent devices 41, 42 and 43 (shown in FIG. 2 only in the collapsed or empty position) which co-operate with latch devices 45 provided on three similar resiliently biassed arms 51, 52 and 53 constituting the previously mentioned guide means 12. In use, when the storage means 10 is empty and the trough 16 is moved into its collapsed or empty position as indicated at 16' the arms 51, 52 and 53 are pulled down about their pivotal mounting 54 until the latch devices 45 are retainably engaged by the detent devices 41, 42 and 43. In FIGS. 1, 2 & 3 the arms are indicated in their collapsed position 51', 52' and 53' the catch means by 40' and the latch devices by 45'. A rotary cam operated release mechanism 55 is provided which when actuated acts on a tail portion 56 of the resilient detent devices to move the detent devices against their resilient bias to release the latch devices and permit the arms to pivot upwards towards the mine roof 5 under the action of their resilient bias.

The arms 51, 52 and 53 are resiliently biassed by a series of coil springs 58, 59, 60 and 61 mounted on a cross pin 63 constituting pivotal mounting 54 and fixedly supported at one end on a support bracket 64 secured to the cowl component 1. A series of alternative anchor holes 65 are provided in the support bracket 64 for retainable engagement by one end of the coil spring 51, the other end of the spring 61 being retainably engaged in one of a series of holes (similar to holes 66 in arm 51) provided in the arm 53. The plurality of holes 65, 66 are provided to permit simple adjustment in the preselected setting of the coil spring action. The ends of the coil springs 59 and 60 are engaged in holes (similar to holes 66) provided in the arms 51, 52 and 53 so as to urge the arms towards the mine roof 5. The remaining coil spring 58 has one end engaged in one of the holes 66 provided in the arm 51 and the other end fixedly retained in a radial groove formed in the cross pin 63, the end of the spring being retained in the groove by a removable end cap 68 located on the end of cross pin 63.

Each of the arms 51, 52 and 53 has a curved flange 70 for guiding the run 72 of elongate material towards the mine roof 5. In addition a curved guide 73 (not shown in FIGS. 2 and 3) is provided for guiding the run 72 around the pivoted mounting 54.

In use, as the mining machine traverses along the working face with the rotary cutter winning mineral to expose the mine roof 5 elongate material such as wire mesh or wire mesh with a sheet backing is unwound from the coil or reel 11 and passed around the guide 73 towards the flanges 70 which under the action of the springs 58, 59, 60 and 61 urge run 72 of elongate material towards the mine roof 5 where it is supported by newly advanced mine roof supports and/or is attached along one edge to the next adjacent layer of material which was laid on the previous traverse of the machine along the face.

When the machine reaches the end of the working face, the elongate material is cut and the coil or reel 11 is removed from the storage means 10 which thereby moves under the action of the spring 31 towards its collapsed or empty position. The arms 51, 52 and 53 are then pulled down against the action of their resilient loading until the latch devices retainably engage the detent devices of the latch means 40. The cowl may then be moved around the rotary cutter in well known manner and re-installed on the opposite side of the rotary cutter which side now becomes the current rear of the cutter as the machine traverses along the face in the opposite direction. During movement of the machine in the direction the elongate material is dispensed from another cowl similar to that described herein but associated with another rotary cutter.

Alternatively, the machine may be flitted back along the working face.

In either case when the machine reaches the end of the working face the cowl and dispensing equipment are set up as previously described with reference to the drawings ready for the next cutting traverse of the machine along the working face.

From the above description it will be appreciated that the present invention provides a simple and convenient equipment for laying a layer of elongate material along a newly exposed mine roof.

In modifications of the invention, a second coil spring 31 may be mounted on the cross pin 20 on the opposite side of the central bush 32.

In alternative embodiments of the invention the dispensing equipment may be provided with further guide material arranged to lay elongate material along the mine roof irrespective of the direction of machine travel along the working face.

I claim:

1. Equipment for laying a layer of elongate material adjacent to a newly exposed rock or mineral surface formed by a mining machine cutter as the machine traverses along a working face, a loading component for cut rock or mineral being positioned adjacent to the rear of the cutter, comprising storage means for a coil of elongate material which, in use, as the machine traverses along the working face is uncoiled, and resilient guide means for guiding a newly unwound portion of the elongate material towards said newly exposed rock or mineral surface, the storage means and the resilient guide means being securable to the loading member component.

2. Equipment as claimed in claim 1, in which the storage means when empty is collapsable.

3. Equipment as claimed in claim 1, the guide means comprises a plurality of resilient fingers adapted to be pivotally mounted relatively to the loading member component.

4. A loading member for a mining machine including a cutter comprising a loading member component for mounting adjacent to the rear of the cutter, and equipment for laying a layer of elongate material adjacent to a newly exposed rock or mineral surface formed by a mining machine cutter as the machine traverses along a working face, the equipment comprising storage means for a coil of elongate material which, in use, as the machine traverses along the working face is uncoiled and resilient guide means for guiding a newly unwound portion of the elongate material towards said newly exposed rock or mineral surface, the storage means and the resilient guide means being securable to the loading member component.

5. A mining machine comprising a rock or mineral cutter which in use as it traverses along a working face cuts rock or mineral from the face, a loading member component mountable adjacent to the rear of the cutter and equipment for laying a layer of elongate material adjacent to a newly exposed rock or mineral surface formed by the cutter as the machine traverses along the working face, the equipment comprising storage means for a coil of elongate material which, in use, as the machine traverses along the working face is uncoiled, and resilient guide means for guiding a newly unwound portion of the elongate material towards said newly exposed rock or mineral surface, the storage means and the resilient guide means being securable to the loading member component.

6. A machine as claimed in claim 5, in which the storage means is collapsable when empty.

7. A machine as claimed in claim 5, in which the guide means comprises a plurality of resilient fingers adapted to be pivotally mounted relatively to the loading member component.

8. Equipment for laying a layer of elongate material adjacent to a newly exposed rock or mineral surface formed by a mining machine cutter as the machine traverses along a working face, the mining machine having a machine body, a cutter connected to the body and mounted thereon for trailing behind the machine body as the machine traverses along a working face, a loading member component for cut rock or mineral being connected to the machine body and positioned adjacent to the rear of the cutter for trailing behind the machine body and behind the cutter as the machine traverses along the working face, comprising storage means for a coil of elongate material which, in use, as the machine traverses along the working face is uncoiled, and resilient guide means for guiding a newly unwound portion of the elongate material towards said newly exposed rock or mineral surface, the storage means and the resilient guide means being securable to the loading member component.

9. Equipment as claimed in claim 8, in which the storage means when empty is collapsible.

10. Equipment as claimed in claim 8, the guide means comprises a plurality of resilient fingers adapted to be pivotally mounted relatively to the loading member component.

* * * * *